US005516278A

United States Patent [19]

Morrison

[11] Patent Number: 5,516,278

[45] Date of Patent: May 14, 1996

[54] FORCED DRAFT MIXER AND BURNER ASSEMBLY WITH PRESSURE DISTRIBUTION DEVICE

[75] Inventor: R. Dean Morrison, El Paso, Tex.

[73] Assignee: AOS Holding Company, Milwaukee, Wis.

[21] Appl. No.: 400,702

[22] Filed: Mar. 8, 1995

[51] Int. Cl.[6] ..... F23C 5/08

[52] U.S. Cl. ..... 431/171; 431/172; 431/328; 122/155.2

[58] Field of Search ..... 431/171, 172, 431/328, 354; 122/244–246, 250 R, 248, 44.2, 155.2, 503

[56] References Cited

U.S. PATENT DOCUMENTS

| | | | |
|---|---|---|---|
| 2,053,652 | 9/1936 | Blanchard et al. | 263/33 |
| 2,116,298 | 5/1938 | Ball et al. | 122/155.2 |
| 2,480,547 | 8/1949 | Caracristi | 110/104 |
| 3,180,322 | 4/1965 | Gibbard | 431/172 |
| 3,796,209 | 3/1974 | Luft | 126/59.5 |
| 3,863,620 | 2/1975 | Warner | 431/172 |
| 4,003,693 | 1/1977 | Straitz, III | 431/202 |
| 4,327,671 | 5/1982 | Zimmer | 122/155.2 |
| 4,624,216 | 11/1986 | Ospelt | 122/155.2 |
| 4,688,496 | 8/1987 | Schreter | 110/264 |
| 4,718,359 | 1/1988 | Skoog | 110/264 |
| 5,092,762 | 3/1992 | Yang | 431/184 |
| 5,171,144 | 12/1992 | Gerstmann et al. | 431/159 |

*Primary Examiner*—Carroll B. Dority
*Attorney, Agent, or Firm*—David R. Price; James Earl Lowe, Jr.

[57] ABSTRACT

Combustion apparatus comprising a combustion chamber, a forced draft mixer and burner assembly extending into the combustion chamber, the assembly including a mixing tube having an open end, an opposed closed end, and a generally cylindrical, foraminous side wall extending between the ends, and a plurality of generally circular disks supported in the tube in spaced-apart relation over the length of the tube, the diameters of the disks increasing in the direction from the open end to the closed end, a blower for supplying air to the to the open end of the mixing tube, and a heat exchanger located in the combustion chamber adjacent the mixer and burner assembly.

22 Claims, 2 Drawing Sheets

FORCED DRAFT MIXER AND BURNER ASSEMBLY WITH PRESSURE DISTRIBUTION DEVICE

BACKGROUND OF THE INVENTION

The invention relates to mixer and burner assemblies, and more particularly to mixer and burner assemblies for forced draft combustion systems.

A conventional forced draft combustion system is disclosed in U.S. Pat. No. 5,171,144, which is assigned to the assignee hereof. A conventional system is also illustrated in FIG. 1. The system includes a cylindrical combustion chamber 1, a mixer and burner assembly 2 extending into the combustion chamber, a blower 3 for supplying air to the mixer and burner assembly, and a heat exchanger coil 4 surrounding the mixer and burner assembly in the combustion chamber. The mixer and burner assembly includes a mixing tube 5 having an open upper end, a closed lower end, and a cylindrical side wall 6 extending between the ends. The side wall is foraminous or porous, i.e., the side wall has therein many small orifices 7 through which combustion air flows out of the tube. The air is ignited by an ignitor 8 outside of the tube and heats liquid in the heat exchanger coil.

In order to evenly distribute air pressure over the length of the tube, the system also includes a pressure distribution cone 9 inside the tube. The pressure distribution cone is made of perforated metal, and the base of the cone sits on the closed lower end of the tube. Without the cone, air pressure tends to be significantly greater near the closed end of the tube than near the open end. This results in more flame adjacent the closed end. The cone equalizes air pressure over the length of the tube, so that the flame is substantially the same over the length of the tube.

SUMMARY OF THE INVENTION

While the above-described pressure distribution cone is effective for its intended purpose, it can be very expensive. The invention provides a pressure distribution device that is considerably less expensive and equally effective.

The pressure distribution device of the invention includes a plurality of plates, preferably circular disks, supported in the tube in spaced relation over the length of the tube. The disks are perpendicular to the tube axis and are preferably perforated or foraminous. The diameters of the disks increase in the direction from the open end to the closed end, so that the smallest disk is adjacent the open end and the largest disk is adjacent the closed end. The disks are generally evenly spaced, but not necessarily exactly equally spaced. In one embodiment of the invention, six disks are employed, and the two largest disks are closer together than the two smallest disks. In the same embodiment of the invention, the smallest disk has a diameter approximately equal to one-third of the tube diameter, and the largest disk has a diameter approximately equal to four-fifths of the tube diameter.

Other features and advantages of the invention will become apparent to those skilled in the art upon review of the following detailed description, claims and drawings.

Figure 1:
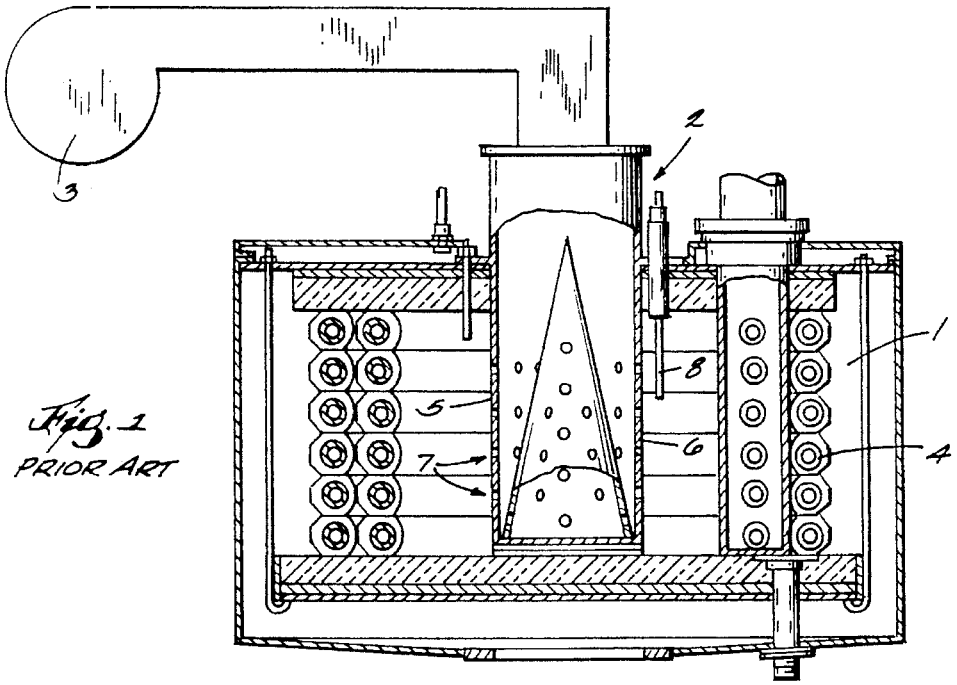
Fig. 1 PRIOR ART
FIG. 1 is a side elevational view, partially in section, of a prior art forced draft combustion apparatus.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

The invention is embodied by a forced draft combustion apparatus 10 that is, except as described below, substantially identical to the apparatus disclosed in U.S. Pat. No. 5,171,144, which is assigned to the assignee hereof and which is incorporated herein by reference.

Figure 2:
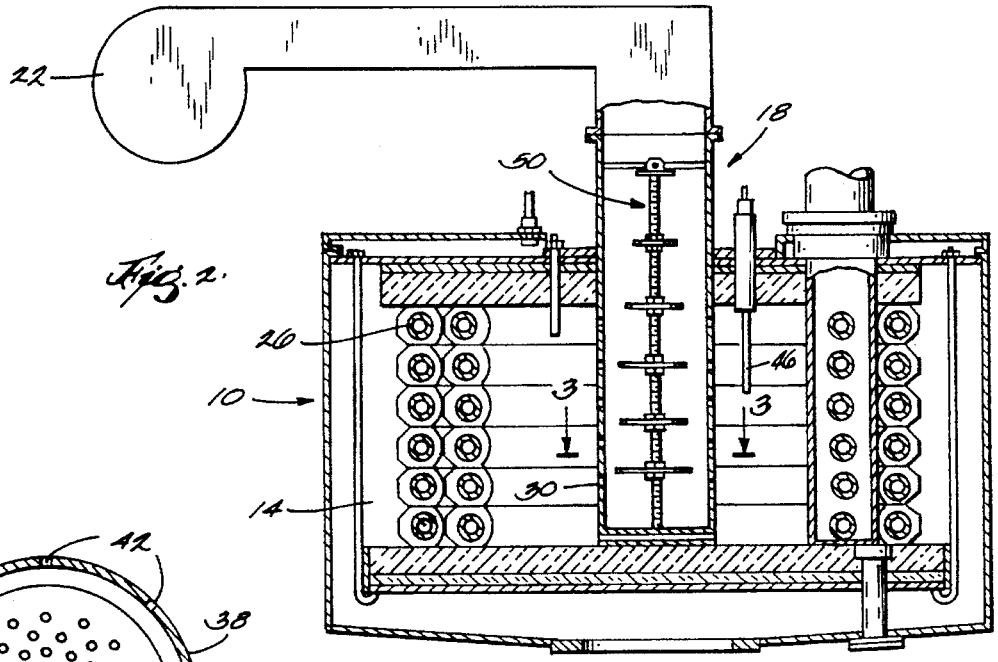
FIG. 2 is a side elevational view, partially in section, of a forced draft combustion apparatus embodying the invention.
Figure 3:
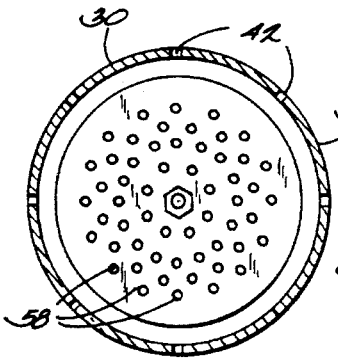
FIG. 3 is a view taken along line 3—3 in FIG. 2.
Figure 4:
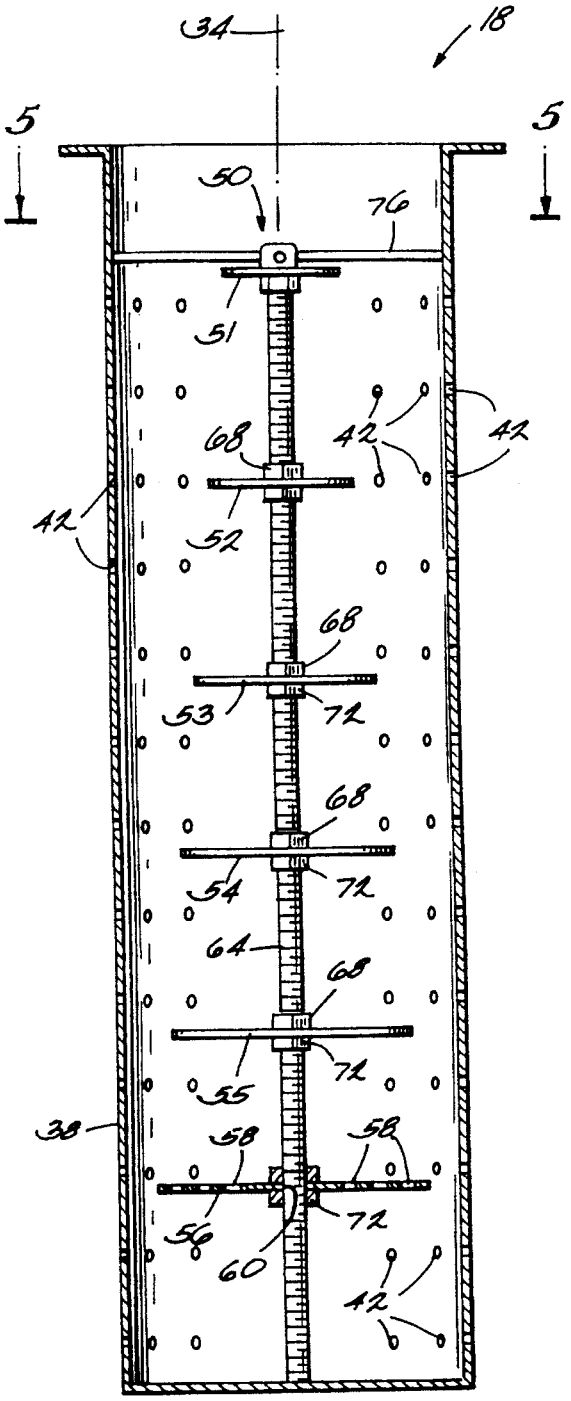
FIG. 4 is an enlarged portion of FIG. 2.
Figure 5:
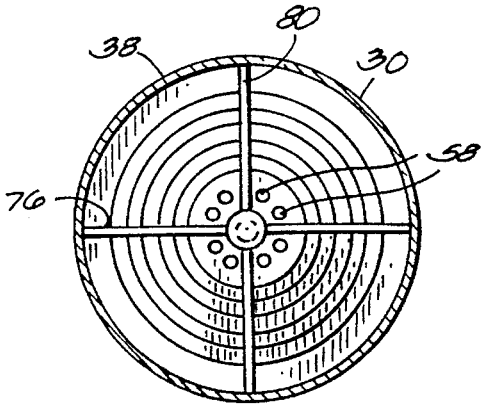
FIG. 5 is a view taken along line 5—5 in FIG. 4.

The apparatus 10, which is illustrated in FIGS. 2–5, comprises (see FIG. 2) a cylindrical combustion chamber 14, a mixer and burner assembly 18 extending into the combustion chamber 14, a blower 22 for supplying air to the mixer and burner assembly 18, and a heat exchanger coil 26 surrounding the mixer and burner assembly 18 in the combustion chamber 14. The combustion chamber 14, the blower 22 and the heat exchanger coil 26 are conventional and will not be described in greater detail.

The mixer and burner assembly 18 includes (see FIG. 4) a mixing tube 30 having a generally vertical longitudinal axis 34, an open upper end, a closed lower end, and a side wall 38 extending between the ends. The side wall 38 is cylindrical and is centered on the axis 34. In the illustrated construction, the tube 30 has a height of 14.38 inches and a diameter of 4.00 inches. The side wall 38 is foraminous or porous, i.e., the side wall 38 has therein many small orifices 42 through which combustion air flows out of the tube 30. The air is ignited by an ignitor 46 (see FIG. 2) outside of the tube 30 and heats liquid in the heat exchanger coil 26.

The mixer and burner assembly 18 also includes (see FIG. 4) a pressure distribution device 50 for substantially equally distributing air pressure over the length of the side wall 38, so that the flame is substantially the same over the length of the tube 30. In the illustrated construction, the device 50 includes plates 51, 52, 53, 54, 55 and 56 supported in the tube 30 in spaced-apart relation over the length of the tube 30. The plates 51, 52, 53, 54, 55 and 56 are preferably foraminous or perforated and each has therethrough a plurality of openings 58 (see FIGS. 3, 4 and 5). The plates are preferably circular disks extending perpendicular to the axis 34. The disks 51, 52, 53, 54, 55 and 56 each have therein a central bore 60 (see FIG. 4), and the disks are supported in the tube 30 by a rod 64 which extends along the axis 34 and through the bores 60 of the disks. Each disk is fixed relative to the rod 64 by upper and lower nuts 68 and 72 threaded onto the rod 64. The upper end of the rod 64 is fixed relative to the tube 30 by perpendicular support rods 76 and 80 (see FIG. 5) secured to the tube 30 and to the rod 64.

The disks 51, 52, 53, 54, 55 and 56 are generally evenly spaced, although not exactly evenly spaced, over the length of the tube 30. In the illustrated embodiment (see FIG. 4), the disk 51 is 1.34 inches below the top of the tube 30, the disk 52 is 2.50 inches below the disk 51, the disk 53 is 2.31 inches below the disk 52, the disk 54 is 2.00 inches below the disk 53, the disk 55 is 2.06 inches below the disk 54, and the disk 56 is 1.81 inches below the disk 55.

Furthermore, the diameters of the disks 51, 52, 53, 54, 55 and 56 increase from top to bottom, i.e., in the direction toward the closed end. In the illustrated construction, the disk 51 has a diameter of 1.38 inches, the disk 52 has a diameter of 1.75 inches, the disk 53 has a diameter of 2.13 inches, the disk 54 has a diameter of 2.50 inches, the disk 55 has a diameter of 2.75 inches, and the disk 56 has a diameter of 3.13 inches.

Various features of the invention are set forth in the following claims.

I claim:

1. Combustion apparatus comprising a combustion chamber, a forced draft mixer and burner assembly extending into said combustion chamber, said assembly including a mixing tube having an open end, an opposed closed end, and a generally cylindrical, foraminous side wall extending between said ends, and a plurality of generally circular disks supported in said tube in spaced-apart relation over the length of said tube, the diameters of said disks increasing in the direction from said open end to said closed end, a blower for supplying air to said open end of said mixing tube, and a heat exchanger located in said combustion chamber adjacent said mixer and burner assembly.

2. Apparatus as set forth in claim 1 wherein said tube has a longitudinal axis, and wherein said disks extend generally perpendicular to said axis.

3. Apparatus as set forth in claim 1 wherein said disks are foraminous.

4. Apparatus as set forth in claim 1 wherein said tube has a diameter, wherein said disks include first, second, third, fourth, fifth and sixth disks, wherein said first disk has a diameter approximately equal to one-third of said tube diameter, and wherein said sixth disk has a diameter approximately equal to four-fifths of said tube diameter.

5. Apparatus as set forth in claim 1 wherein said disks include at least three disks, and wherein said disks are generally evenly spaced.

6. Apparatus as set forth in claim 5 wherein said disks include first, second, third, fourth, fifth and sixth disks arranged in the stated order, and wherein said fifth and sixth disks are closer together than said first and second disks.

7. A forced draft mixer and burner assembly comprising a mixing tube including a longitudinal axis, an open end, an opposed closed end, and an endless, porous side wall which extends between said ends and which surrounds said axis, and a pressure distribution device for substantially equally distributing air pressure over said side wall, said device including first and second plates extending generally perpendicular to and being spaced along said axis, said second plate being located between said first plate and said closed end, and said second plate having a greater area than said first plate.

8. Apparatus as set forth in claim 7 wherein said tube is generally cylindrical, and wherein said plates are generally circular.

9. Apparatus as set forth in claim 7 wherein said device also includes a third plate which is located between said second plate and said closed end and which has a greater area than said second plate.

10. Apparatus as set forth in claim 9 wherein said device also includes a fourth plate which is located between said third plate and said closed end and which has a greater area than said third plate.

11. Apparatus as set forth in claim 10 wherein said device also includes a fifth plate which is located between said fourth plate and said closed end and which has a greater area than said fourth plate.

12. Apparatus as set forth in claim 11 wherein said device also includes a sixth plate which is located between said fifth plate and said closed end and which has a greater area than said fifth plate.

13. Apparatus as set forth in claim 12 wherein said tube is cylindrical and has a diameter, wherein said plates are circular, wherein said first plate has a diameter approximately equal to one-third of said tube diameter, and wherein said sixth plate has a diameter approximately equal to four-fifths of said tube diameter.

14. Apparatus as set forth in claim 7 wherein said plates are porous.

15. Apparatus as set forth in claim 7 wherein said device also includes a third plate, and wherein said plates are generally evenly spaced.

16. Apparatus as set forth in claim 15 wherein said device also includes fourth, fifth and sixth plates, and wherein said fifth and sixth plates are closer together than said first and second plates.

17. A forced draft mixer and burner assembly comprising a mixing tube having an open end, an opposed closed end, and a generally cylindrical, foraminous side wall extending between said ends, and a plurality of generally circular disks supported in said tube in spaced-apart relation over the length of said tube, the diameters of said disks increasing in the direction from said open end to said closed end.

18. Apparatus as set forth in claim 17 wherein said tube has a longitudinal axis, and wherein said disks extend generally perpendicular to said axis.

19. Apparatus as set forth in claim 17 wherein said disks are foraminous.

20. Apparatus as set forth in claim 17 wherein said tube has a diameter, wherein said disks include first, second, third, fourth, fifth and sixth disks, wherein said first disk has a diameter approximately equal to one-third of said tube diameter, and wherein said sixth disk has a diameter approximately equal to four-fifths of said tube diameter.

21. Apparatus as set forth in claim 17 wherein said disks include at least three disks, and wherein said disks are generally evenly spaced.

22. Apparatus as set forth in claim 21 wherein said disks include first, second, third, fourth, fifth and sixth disks arranged in the stated order, and wherein said fifth and sixth disks are closer together than said first and second disks.

* * * * *